United States Patent [19]

Mulder

[11] Patent Number: 4,796,400

[45] Date of Patent: Jan. 10, 1989

[54] SKYLIGHT WITH IMPROVED SEAL

[75] Inventor: Lawrence Mulder, Holland, Mich.

[73] Assignee: ODL, Incorporated, Zeeland, Mich.

[21] Appl. No.: 88,563

[22] Filed: Aug. 24, 1987

[51] Int. Cl.[4] ..... E04B 7/18

[52] U.S. Cl. ..... 52/200; 52/745; 49/DIG. 1; 49/DIG. 2; 206/499

[58] Field of Search ..... 52/72, 200, 204, 745; 49/483, 484, 485, 495, DIG. 1, DIG. 2; 206/223, 499, 500, 521

[56] References Cited

U.S. PATENT DOCUMENTS

| | | | |
|---|---|---|---|
| 2,947,267 | 8/1960 | Stark . | |
| 2,968,263 | 1/1961 | Huston et al. . | |
| 3,090,613 | 5/1963 | Bechtold . | |
| 3,350,823 | 11/1967 | Murray . | |
| 3,476,282 | 11/1969 | Monaco et al. | 206/499 X |
| 3,555,752 | 1/1971 | Bogaert . | |
| 3,934,383 | 1/1976 | Perry et al. | 52/200 |
| 4,023,317 | 5/1977 | Bettger et al. | 52/204 |
| 4,073,097 | 2/1978 | Jentoft et al. . | |
| 4,193,237 | 3/1980 | Jankowski . | |
| 4,223,493 | 9/1980 | Moench et al. . | |
| 4,388,784 | 6/1983 | Jentoft et al. . | |
| 4,409,767 | 10/1983 | Jentoft et al. . | |
| 4,439,962 | 4/1984 | Jentoft et al. . | |
| 4,449,340 | 5/1984 | Jentoft et al. . | |
| 4,527,368 | 7/1985 | Jentoft . | |
| 4,570,393 | 2/1986 | Minter | 52/200 X |
| 4,570,394 | 2/1986 | Jentoft et al. . | |
| 4,589,238 | 5/1986 | Sampson et al. . | |

FOREIGN PATENT DOCUMENTS

| | | | |
|---|---|---|---|
| 756739 | 3/1971 | Belgium | 52/200 |

*Primary Examiner*—David A. Scherbel
*Assistant Examiner*—Richard E. Chilcot, Jr.
*Attorney, Agent, or Firm*—Warner, Norcross & Judd

[57] ABSTRACT

The specification discloses an improved skylight construction having a foamable gasket providing a weather seal between the curb and dome. The gasket is applied to the curb and cured prior to mounting of the dome. Consequently, the gasket does not adhere to the dome upon dome removal, permitting the dome to be easily replaced or inverted on the curb for low-profile transportation and storage.

7 Claims, 3 Drawing Sheets

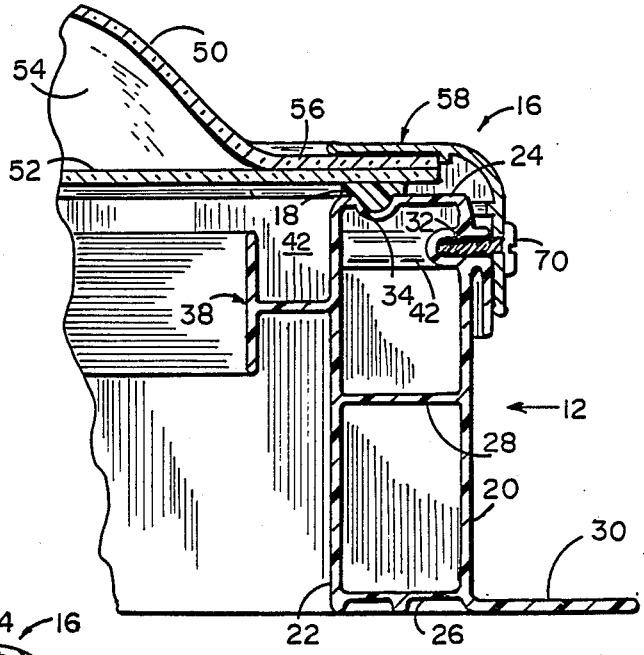
FIG. 3
FIG. 2
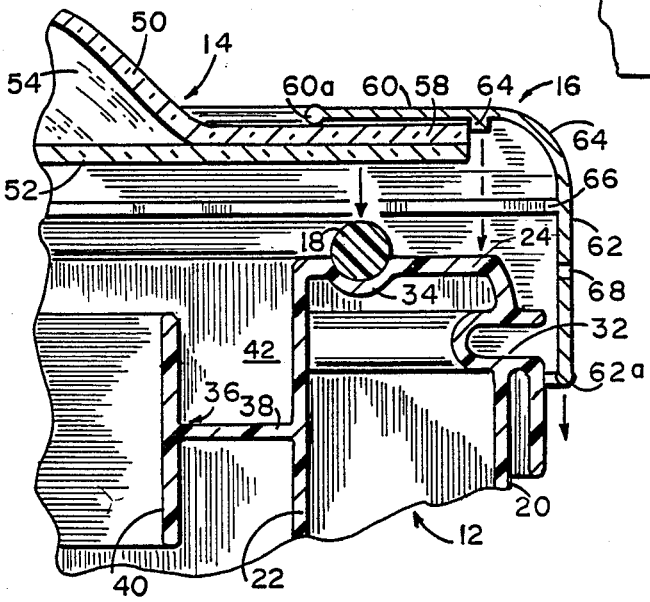
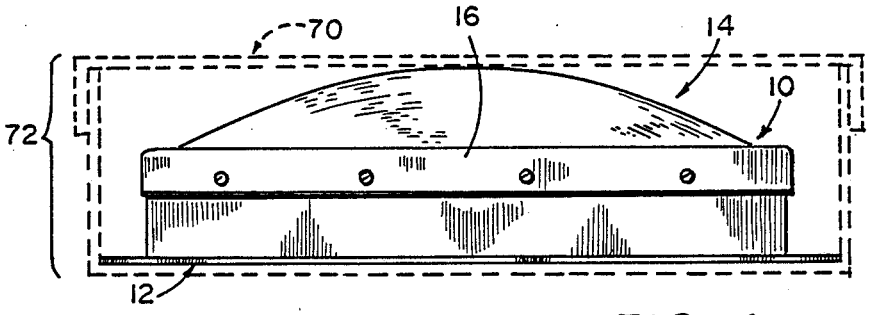
FIG. 4
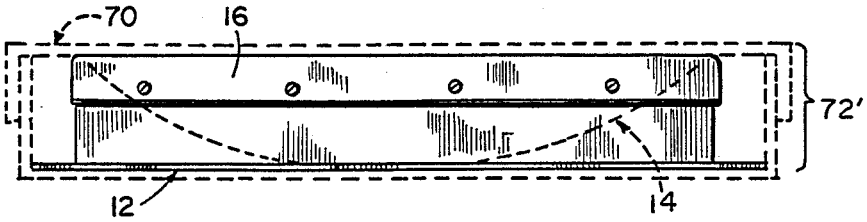
FIG. 5

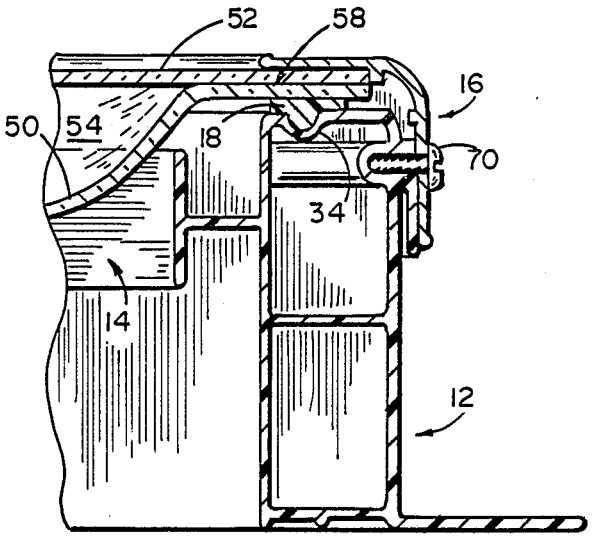
FIG. 6
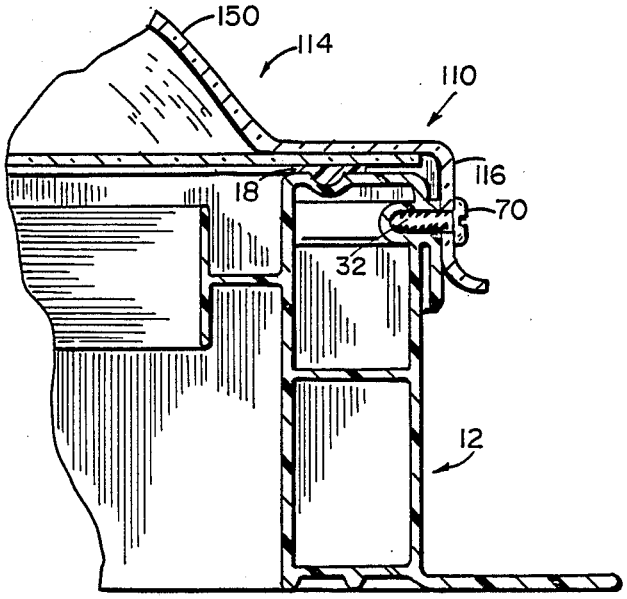
FIG. 7
FIG. 8
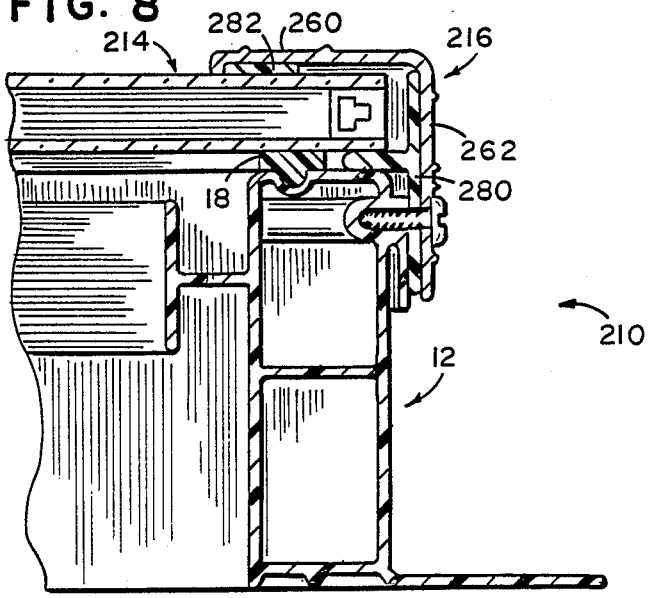

SKYLIGHT WITH IMPROVED SEAL

BACKGROUND OF THE INVENTION

The present invention relates to skylights, and more particularly to such skylights including separate curbs and domes with a seal interposed therebetween.

Skylights are becoming increasingly popular in both commercial and residential construction. Skylights greatly enhance the illumination, and apparent roominess, of a building interior by admitting natural light and providing a psychological feeling of openness not possible with wallmounted windows.

In response to different building needs and different budgets, many different skylight constructions have been developed. One particularly popular type of skylight includes a curb, a dome, a seal interposed between the curb and dome, and a retainer for securing the dome in position on the curb. The curb is a mounting structure supported by the structural roof. The seal is mounted on an upper portion of the curb to support and seal the dome thereagainst. The skylight rests directly on the seal and compresses the seal to form a weather-tight seal between the curb and dome. The retainer fits about the peripheral edge of the dome and is secured to the curb to maintain the dome in position against the curb and draw the dome against the seal.

A wide variety of materials has been developed for use as the seal between the curb and dome. Known materials used to date include neoprene rubber (see U.S. Pat. No. 2,947,267 to Stark and U.S. Pat. No. 4,193,237 to Jankowski), cork and/or plastic (see U.S. Pat. No. 2,968,263 to Huston et al), felt (see U.S. Pat. No. 3,090,613 to Bechtold), foams (see U.S. Pat. Nos. 3,350,823 to Murray, 3,555,752 to Bogaert, and 4,223,493 to Moench et al), butyl tape (see U.S. Pat. No. 4,073,097 to Jentoft et al), and butyl glazing compound. However, all of these materials are not without their drawbacks. For example, the butyl glazing compound (known as a "wet seal") remains soft and tacky throughout its life and adheres to any contacting surface. Consequently, replacement of a dome during installation or subsequent servicing is complicated since the butyl compound must be removed from both the curb and the dome after the skylight is removed and a new butyl seal applied. This is time-consuming in terms of labor and consequently cost. The self-adhesive butyl tape (known as a "dry seal") is relatively thin and therefore requires carefully controlled manufacturing tolerances in the mating surfaces providing contact area with the relatively thin tape. The remaining gasket materials do not adhere to either the curb or skylight. Accordingly, these seals require additional structure to hold them in place. Further, many of these seals have been found to be undesirable for reasons of cost, increased brittleness over time, or inadequate weather sealing.

As a recent development, Wasco Products, Inc. of Sanford, Me. has developed a plastic curb with a coextruded seal having a durometer lower than the curb body (see U.S. Pat. Nos 4,589,238 to Sampson et al; 4,527,368 to Jentoft; and 4,570,394; 4,449,340; and 4,409,767 to Jentoft et al). However, the coextrusions are relatively expensive increasing the resultant cost of the skylight.

Other seals have been developed for different applications in different products. For example, ODL, Incorporated of Zeeland, Mich., the assignee of the present application, has applied a foamable gasket to the exterior frame of a door light to provide an integral weather seal between the frame and the exterior surface of a door in which the light is mounted. The applied gasket is dry to the touch, self-adheres to the frame upon application, and is resiliently compressible. The gasket is positioned to be compressed by the door; and the frame with the integral gasket is therefore ready for installation without the installer having to apply separate glazing.

SUMMARY OF THE INVENTION

The aforementioned problems are overcome in the present invention wherein a skylight construction is provided including an inexpensive, highly effective, and reusable seal affixed to the curb and interposed between the curb and dome. More specifically, the novel seal is a foamable gasket "gunned onto" the dome-support surface of the curb and cured prior to installation of the dome. The gasket is resiliently deformable and permanently adhered to the curb and yet "dry" to the touch after curing. When the dome is seated on the curb, the gasket is compressed between the curb and dome to provide an effective weather seal. The dome can be removed from the curb for servicing or replacement, and the gasket will not adhere to the dome. Consequently, the dome can be repeatedly removed and reinstalled or replaced with another dome in case of damage without having to replace or service the seal.

The present invention also permits a novel shipping arrangement for a skylight having a formed dome. After manufacture and prior to packaging, the dome is inverted on the curb from its normal position so that the formed dome extends downwardly into the curb interior. The dome therefore has a relatively low profile permitting higher density transportation and storage. Further, since the skylight is not "fully assembled" as that term is used in establishing Interstate Commerce Commission (ICC) rates, the skylight may be shipped at a lower rate than a fully assembled unit. When the skylight is to be installed, the dome is removed from the curb, oriented to its normal position wherein the curved dome extends upwardly from the curb, and reseated on the reusable gasket.

These and other objects, advantages, and features of the invention will be more readily understood and appreciated by reference to the detailed description of the preferred embodiment and the drawings.

BRIEF DESCRIPTION OF THE DRAWINGS

FIG. 2 is a sectional view taken along line II—II in FIG. 1 with the dome and retainer elevated slightly above the curb;

FIG. 3 is a sectional view taken along line II—II in FIG. 1 of the fully assembled skylight;

FIG. 4 is a side elevational view of the skylight ready for shipment with the dome uninverted in a carton shown in phantom;

FIG. 5 is an elevational view of the skylight ready for shipment with the dome inverted in a carton shown in phantom;

FIG. 6 is a sectional view similar to FIG. 3 showing the dome inverted for transportation;

FIG. 7 is a sectional view of an alternative embodiment wherein the dome includes an integral retainer flange; and FIG. 8 is a sectional view of a second alternative embodiment of the invention wherein insulated glass is substituted for the curved dome.

DETAILED DESCRIPTION OF THE PREFERRED EMBODIMENT

Figure 1:
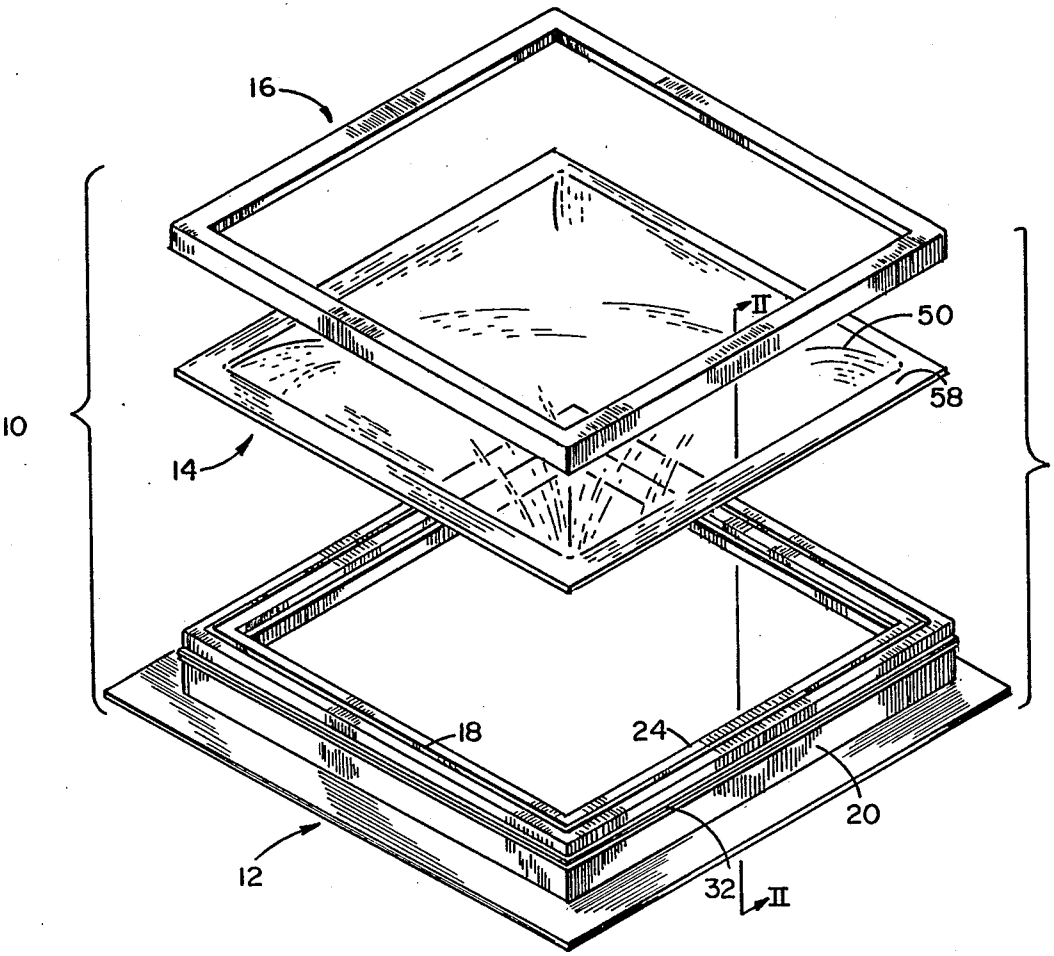
FIG. 1 is a perspective exploded view of the present skylight with improved seal.

A skylight constructed in accordance with a preferred aspect of the invention is illustrated in FIG. 1 and generally designated 10. Basically, the skylight includes a curb 12, a dome 14, a retainer 16, and a seal 18. As seen in greater detail in FIGS. 2 and 3, the seal 18 is applied to the upper portion of the curb 12 and as will be described is adhered thereto. The dome 14 is supported on the curb 12 and the gasket 18 to compress the gasket and provide an air and water seal between the dome and curb. The retainer 16 is fitted over the dome 14 and is secured to the curb 12 to retain the dome position.

The curb 12 is illustrated in detail in FIG. 3. Preferably, the curb 12 is fabricated of four pieces of a plastic extrusion arranged to define a rectangle or square. Preferably, the four pieces are cut and heat-welded at the four corners of the curb to provide secure interconnections. The preferred material is polyvinyl chloride although any other suitable material can be used.

The cross-sectional configuration of the extrusion is illustrated in FIG. 3. The curb extrusion includes an outer wall 20, and inner wall 22, a top wall 24, and a bottom wall 26 arranged to define a basically rectangular shape. An intermediate wall 28 extends between the outer and inner walls 20 and 22 approximately mid-way between the upper and lower walls 24 and 26 for enhanced structural integrity. A flashing flange 30 is oriented generally perpendicularly to the outer wall 20 and extends outwardly from the junction of the outer wall and the lower wall 26. A screw boss 32 is located within the outer wall 20 just below the upper wall 24 to receive the screws 70 holding the retainer 16 in position. The top wall 24 defines a semispherical depression 34 to receive the seal 18 as will be described. Although the depression 34 is illustrated as being closer to the inner wall 22 than the outer wall 20, the depression can be located anywhere along the width of the upper wall. A T-flange 36 includes a stem 38 oriented perpendicularly to the inner wall 22 and a crossbar 40 oriented generally perpendicularly to the stem. The upper portion of the inner wall 22, the stem 38, and the crossbar 40 together define a condensation trough or gutter 42 around the entire periphery of the curb 12 to collect condensation which may collect on the dome interior. All of the portions of the curb 12 are generally uniform in thickness to facilitate extrusion and subsequent curing.

The dome 14 (see FIGS. 2 and 3) is of conventional construction and is either fabricated of an acrylic material or a polycarbonate material. The dome 14 includes an outer dome or glazing panel 50 and an inner flat sheet or glazing panel 52. The inner glazing panel 50 is generally planar throughout its extent and is rectangular or square having dimensions generally common to the curb 12. The outer dome 50 is nonplanar and arches upwardly above the inner panel 52 to define an insulation space 54 therebetween. The dome 50 includes a flap peripheral portion 56 which is bonded to the peripheral portion of the inner sheet 52 in conventional fashion using a silicon adhesive. The peripheral portion 58 of the dome 14 rests on the seal or gasket 18. As illustrated in FIG. 3, the glazing supports the peripheral edge 58 slightly above the upper wall 24. It is also possible that the seal 18 is sufficiently compressed so that the peripheral portion 58 rests directly on the upper wall 54.

The gasket or seal 18 is adhered to the upper wall 24 of the curb 12 preferably within the depression 34 to provide an air and water weather seal between the curb 12 and the dome 14. The seal 18 is a "foaming gasket", refering to any polymeric material which is applied as a liquid and injected with gas and having a melting point higher than normal maximum roof temperatures of 160 degrees to 180 degrees F.

In the presently preferred embodiment, the polymeric materials used in creating the foamable gasekt 18 are those sold under the designations X195-338-01 and X195-337-01 by Findley Adhesives Inc. of Elm Grove, Wis. This material is a polymeric hot-melt adhesive having a softening point of 219 degrees F. and a melting point of 280 degrees F. The viscosity at 325 degrees F. is 9,000 cps and at 350 degrees F. is 3,000 cps. To create the foamable gasket 18 this material is applied to the curb 12 at a temperature in the range of 350 degrees to 375 degrees F. and is injected with nitrogen gas in the range of 40% to 50% by volume. Other suitable materials for creating foamable gaskets are known to those having ordinary skill in the art.

The retainer 16 is generally conventional in the art. In the preferred embodiment, the retainer 16 is fabricated of an aluminum extrusion mitered and joined at four corners to define a rectangle or square to fit about the curb 12. The retainer 16 includes an upper flange 60 and a side flange 62 joined by a curved corner portion 64. Both the upper flange 60 and the side flange 62 terminate in slightly bulbous edges 60*a* and 62*a* respectively. A locator ridge 64 extends downwardly from the upper flange 60 adjacent the curved portion 64; and a locator ridge 66 extends inwardly from the side flange 62 adjacent the curved portion. As illustrated in FIGS. 2 and 3, the locator ridge 64 abuts the outer most edge of the peripheral portion 58 of the dome 14 to properly orient the dome with respect to the curb 12. The locator ridge 66 will engage the upper portion of the screw boss 32 if an attempt is made to force the retainer 16 downwardly too far with respect to the curb 12. The side flange 62 defines a plurality of screw holes 68 along its length for receiving screws 70 which extend therethrough to be secured in the screw boss 32. When so secured, the retainer 16 both orients the dome 14 with respect to the curb 12 and retains the dome in position on the curb.

ASSEMBLY

The curb 12 is fabricated by mitering and joining four extrusion segments into the illustrated rectangular or square configuration. Preferably, the four corners are heat-welded to provide a strong and reliable seal at the corners. The foamable gasket 18 is then gunned onto the curb 12 in the depression 34 in the upper wall 24. Preferably, the seal 18 is applied as a continuous bead around the entire periphery of the curb 12 with the starting and ending ends of the bead slightly overlapping to provide a continuity of seal. In particular, the seal is preferably continuous through each corner of the curb. Being in liquid form upon application, the gasket material 18 adheres and/or bonds to the plastic curb 12 upon curing. Further, the foamable gasket after during is a semi-rigid material which will not adhere to other materials and in particular will not adhere to the dome 14.

After the seal 18 has cured, which typically requires approximately 60 seconds, the dome is placed into position on the curb 12 so that the dome arches above the curb. As illustrated in FIG. 2, the seal initially has a generally circular configuration. After the dome 14 is placed thereon, the seal is compressed outwardly from its circular configuration to overlie adjacent portions of the top wall 24 adjacent either side of the depression 34. With the dome 14 in position, the retainer 16 is applied over the dome; and the retainer 16, the dome 14, or both are adjusted as necessary to insure that the locator ridge 64 is positioned about the periphery of the peripheral portion 58. Screws—preferably #8 by ⅜"—are installed within the retainer side flange 62 and secured in the screw boss 32 in the curb. FIG. 4 illustrates in phantom a shipping carton 70 containing the fully assembled skylight 14. It will be noted that the height of the shipping carton 72 includes the combined height of the curb 12 and the dome 14.

ALTERNATE ASSEMBLY

An alternate assembly for the skylight 10 is illustrated in FIGS. 5 and 6. This assembly differs from the previously described assembly primarily in the orientation of the dome 14. Rather than being installed in its conventional orientation, the dome is installed in an "inverted" position with the outer dome 50 extending downwardly into the interior of the curb 12. The profile 72' of the skylight kit assembled in this matter is only slightly greater than the height of the curb 12 alone. Consequently, the profile 72' of the alternate skylight kit (FIG. 5) is approximately one-half of the profile 72 of the fully assembled skylight 10 (FIG. 4).

This described alternate skylight kit has at least two distinct advantages. First, since the profile is approximately one-half of the fully assembled skylight, approximately twice as many kits can be packed or stored within the same volume for transportation or storage. Second, the alternate kit with the dome inverted is not "fully assembled" as that term is used by the Interstate Commerce Commission; and accordingly the transportation rates are lower than for the fully-assembled skylight.

Installation of the skylight kit 10' at an installation site is relatively simple. The retainer 16 is removed; the dome 14 is removed and inverted to its conventional position; and the retainer 16 is reinstalled to secure the dome in its "proper" position. Because the novel gasket of the present invention does not adhere to the dome 14, this minor final assembly step is easily performed and results in a resealed unit ready for use.

ALTERNATE EMBODIMENTS

Alternate embodiments 119 and 210 of the skylight construction are illustrated in FIGS. 7 and 8, respectively. In both alternate embodiments, the curb 12 and the seal 18 are identical to those described above.

In alternate skylight 110 (FIG. 7) the skylight 114 includes an integral retaining flange 116. Screws 70 are inserted through the retaining flange 116 and into the screw boss 32 to secure the dome 114 in position. It will be noted that the dome 114 includes an upwardly arched outer panel 150. Consequently, the dome 114 may be inverted for shipment and transportation in a fashion similar to that described above.

The alternate construction 210 (FIG. 8) utilizes ⅝" insulating glass 214 in place of an acrylic or polycarbonate dome. A retainer 216 of slightly different profile, but still having an upper flange 260 and a side flange 262, is used to secure the glass in position. Setting blocks 280 behind the retainer side flange 262 are placed between the insulating glass 214 and the curb 12 to partially bear the weight of the insulated glass. Butyl tape 282 is placed between the upper retainer flange 260 and the insulating glass 214 to further seal the resultant assembly. Since the insulating glass 214 is planar on both its upper and lower surfaces, the glass is not inverted for transportation and storage as with the previously described embodiments.

Thus, it is seen that the present invention provides a relatively low cost, yet high efficient and reliable, skylight construction. The plastic curb contributes to the low cost of the construction. The unique foamable gasket between the curb and skylight provides an inexpensive, reliable, and reusable seal. Since the seal is easily reusable, the dome can be inverted for shipment with the attendant economies.

The above descriptions are preferred embodiments of the invention. Various alternations and changes can be made without departing from the spirit and broader aspects of the invention as set forth in the appended claims, which are to be interpreted in accordance with the principles of patent law including the doctrine of equivalents.

The embodiments of the invention in which an exclusive property or privilege is claimed are defined as follows:

1. A method of manufacturing and installing a skylight comprising the steps of:

applying a gasket to the dome-supporting portion of a skylight curb;

mounting a skylight dome on the skylight curb with the curved dome extending downwardly beyond the glass-supporting portion of the curb;

transporting the curb and skylight mounted thereon to an installation site;

removing the dome from the curb;

mounting the dome on the skylight curb with the curved dome extending upwardly from the glass-supporting portion; and installing the skylight curb in a roof, said installing step occurring either before or after the dome is remounted on the curb.

2. A method of manufacturing and installing a skylight as defined in claim 1 wherein at least said second mounting step includes securing the dome to the curb using a retainer releasably securable to the curb.

3. A method as defined in claim 1 wherein said gasket comprises a foamable gasket.

4. A skylight kit comprising:

a curb assembly for supporting a dome on a roof, said curb assembly including an upwardly facing support portion defining a plane;

a gasket adhered to said support portion; and a dome including an arched panel and a peripheral portion extending thereabout and defining a plane, said peripheral portion engaging at least one of said support portion and said gasket, said arched panel extending downwardly from said support portion and into the interior of said curb assembly, whereby said kit presents a low profile for storage and transportation, and further whereby said dome can be removed from said curb assembly, inverted, and reseated on said curb assembly and gasket upon installation in a roof.

5. A skylight kit as defined in claim 4 further comprising retainer means for retaining said dome on said curb assembly, said retainer means including securing means for releasably securing said retainer means to said curb assembly.

6. A Skylight kit as defined in claim 4 wherein said gasket comprises a foamable gasket.

7. A method of manufacturing a skylight comprising:

constructing a curb assembly having a dome-supporting surface;

applying a foamable gasket to the dome-supporting surface;

allowing the foamable gasket to cure; and releasably mounting a dome on the foamable gasket and dome supporting surface in an unconventional inverted position wherein a non-planar outer dome panel extends into the curb assembly to reduce the profile of the skylight assembly for shipping, whereby said dome is adapted to be reversed for installation and mounted on the foamable gasket and dome supporting surface in a conventional position such that the foamable gasket is compressed between the dome and curb assembly to provide an air-and-water seal.

* * * * *